US011047605B2

(12) United States Patent
Kondo et al.

(10) Patent No.: US 11,047,605 B2
(45) Date of Patent: Jun. 29, 2021

(54) EVAPORATOR AND REFRIGERATOR

(71) Applicant: MITSUBISHI HEAVY INDUSTRIES THERMAL SYSTEMS, LTD., Tokyo (JP)

(72) Inventors: Yoshiyuki Kondo, Tokyo (JP); Takuo Oda, Tokyo (JP); Yasushi Hasegawa, Tokyo (JP); Naoya Miyoshi, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 524 days.

(21) Appl. No.: 15/320,168

(22) PCT Filed: Apr. 21, 2015

(86) PCT No.: PCT/JP2015/062097
§ 371 (c)(1),
(2) Date: Dec. 19, 2016

(87) PCT Pub. No.: WO2016/047185
PCT Pub. Date: Mar. 31, 2016

(65) Prior Publication Data

US 2017/0153049 A1 Jun. 1, 2017

(30) Foreign Application Priority Data

Sep. 25, 2014 (JP) ..... JP2014-195190

(51) Int. Cl.
*F25B 39/00* (2006.01)
*F28F 9/22* (2006.01)
(Continued)

(52) U.S. Cl.
CPC ..... *F25B 39/00* (2013.01); *F25B 25/005* (2013.01); *F25B 39/02* (2013.01); *F28D 7/163* (2013.01);
(Continued)

(58) Field of Classification Search
CPC ..... F25B 39/00; F25B 39/02; F25B 39/028; F25B 2339/0242; F25B 25/005;
(Continued)

(56) References Cited

U.S. PATENT DOCUMENTS 3,276,218 A 10/1966 Leonard, Jr.
3,385,348 A 5/1968 Embury
(Continued)

FOREIGN PATENT DOCUMENTS

CN 1400443 A 3/2003
DE 1476994 A1 10/1969
(Continued)

OTHER PUBLICATIONS

English translation of JP2004092927.*
(Continued)

*Primary Examiner* — Edward F Landrum
*Assistant Examiner* — Melodee Jefferson
(74) *Attorney, Agent, or Firm* — Birch, Stewart, Kolasch & Birch, LLP

(57) ABSTRACT

An evaporator includes: a vessel having a refrigerant inlet for receiving a refrigerant at a lower part of the vessel, and a refrigerant outlet for discharging the refrigerant in an evaporated state at an upper part of the vessel; and a plurality of heat-transfer tubes disposed so as to extend inside the vessel along a longitudinal direction of the vessel, and configured to transfer heat received from a fluid flowing inside the heat-transfer tubes to the refrigerant flowing outside the heat-transfer tubes. The plurality of heat-transfer tubes are disposed so that at least one downward flow passage is defined through the plurality of heat-transfer tubes or around the plurality of heat-transfer tubes, the at least one downward flow passage having a width larger than a representative interval between the plurality of heat-
(Continued)

transfer tubes. A representative interval between the plurality of heat-transfer tubes disposed on an upper side among the plurality of heat-transfer tubes is larger than a representative interval between the plurality of heat-transfer tubes disposed on a lower side among the plurality of heat-transfer tubes.

13 Claims, 8 Drawing Sheets

(51) Int. Cl.

| | |
|---|---|
| ***F25B 39/02*** | (2006.01) |
| ***F25B 25/00*** | (2006.01) |
| ***F28F 9/00*** | (2006.01) |
| ***F28D 7/16*** | (2006.01) |
| ***F28F 9/013*** | (2006.01) |
| ***F28F 13/00*** | (2006.01) |
| ***F28D 21/00*** | (2006.01) |
| ***F28D 1/02*** | (2006.01) |

(52) U.S. Cl.
CPC ..... *F28D 7/1607* (2013.01); *F28F 9/005* (2013.01); *F28F 9/0131* (2013.01); *F28F 9/22* (2013.01); *F28F 13/003* (2013.01); *F25B 39/028* (2013.01); *F25B 2339/0242* (2013.01); *F28D 1/0213* (2013.01); *F28D 2021/0071* (2013.01); *F28F 2009/226* (2013.01); *F28F 2210/08* (2013.01)

(58) Field of Classification Search
CPC ..... F28D 7/163; F28D 7/1607; F28D 2021/0071; F28D 1/0213; F28F 9/005; F28F 9/0131; F28F 9/22; F28F 13/003; F28F 2009/226; F28F 2210/08
See application file for complete search history.

(56) References Cited

U.S. PATENT DOCUMENTS

| | | | | |
|---|---|---|---|---|
| 6,293,112 | B1 | 9/2001 | Moeykens et al. | |
| 6,655,173 | B2 | 12/2003 | Iritani et al. | |
| 7,472,563 | B2 | 1/2009 | Knoll et al. | |
| 2002/0046572 | A1 | 4/2002 | Iritani et al. | |
| 2004/0112573 | A1 | 6/2004 | Moeykens | |
| 2005/0039486 | A1 | 2/2005 | Knoll | |
| 2005/0167089 | A1 * | 8/2005 | Ozeki | F28D 7/16 165/162 |
| 2008/0041096 | A1 | 2/2008 | Sakashita et al. | |

FOREIGN PATENT DOCUMENTS

| | | | | | |
|---|---|---|---|---|---|
| EP | 2450645 | A2 | | 5/2012 | |
| JP | 2001-215070 | A | | 8/2001 | |
| JP | 2002-349999 | A | | 12/2002 | |
| JP | 2002349999 | A | * | 12/2002 | |
| JP | 2004-92927 | A | | 3/2004 | |
| JP | 2004-92991 | A | | 3/2004 | |
| JP | 2004092927 | A | * | 3/2004 | F28F 9/02 |
| JP | 2004092927 | A | * | 3/2004 | |
| JP | 3572250 | B2 | | 9/2004 | |
| JP | 2005-221118 | A | | 8/2005 | |
| JP | 2008-138891 | A | | 6/2008 | |
| JP | 4202928 | B2 | | 12/2008 | |
| JP | 4451998 | B2 | | 4/2010 | |
| JP | 2012-163243 | A | | 8/2012 | |
| JP | 2012-207874 | A | | 10/2012 | |
| WO | 02/42696 | A1 | | 5/2002 | |

OTHER PUBLICATIONS

English Translation of Iritani JP2004092927A (Year: 2019).*
English Translation of Shirakata JP2002349999A (Year: 2019).*
International Preliminary Report on Patentability effective Apr. 6, 2017, issued to International Application No. PCT/JP2015/062097.
HFC-kei Reibai Teisu no Hyojunchi, [online], Standard value of HFC refrigerant constant, Japan Society of Rifrigerating and Air Conditioning Engineers, Mar. 27, 2013, [retrieval date: Jul. 8, 2015], Internet <URL:https://web.archive.org/web/20140810105639/http://www.jsrae.or.jp/osi/HFC.html>.
Office Action dated Aug. 4, 2017 issued to JP Application No. 2014-195190 with an English Machine Translation.
First Office Action effective Feb. 27, 2018 issued to the corresponding CN Application No. 201580030444.2 with Machine Translation.
First Office Action dated Mar. 30, 2018 in the corresponding Japanese Application No. 2014-195190 with a Machine Translation.
German Office Action, dated Feb. 28, 2020, for German Application No. 112015004397.7.

* cited by examiner

EVAPORATOR AND REFRIGERATOR

TECHNICAL FIELD

The present disclosure relates to an evaporator and a refrigerator including the evaporator.

BACKGROUND ART

In an evaporation step of a refrigeration cycle, an evaporator is normally used to evaporate a refrigerant expanded in an expansion step.

For instance, Patent Document 1 discloses an evaporator provided with a vessel and a plate-shaped heat exchanger housed in the vessel. In the evaporator of Patent Document 1, a path is formed between the plate-shaped heat exchanger and the vessel so that a liquid refrigerant that flows around the plate-shaped heat exchanger inside the vessel smoothly returns to a bottom part of the vessel and flows in circulation without mixing with an evaporated gas flow of the refrigerant flowing upward.

Furthermore, Patent Document 2 discloses an evaporator provided with a vessel and a number of heat-transfer tubes disposed inside the vessel. A liquid refrigerant is supplied to the bottom side of the vessel, and evaporated refrigerant gas flows out from the upper side of the vessel. A target of cooling flows inside the heat-transfer tubes, whereby heat is exchanged between the refrigerant and the target of cooling via the heat-transfer tubes.

CITATION LIST

Patent Literature

Patent Document 1: JP4202928B
Patent Document 2: JP2002-349999A

SUMMARY

Problems to be Solved

In an evaporator, a phenomenon called dry out may occur, where gas surrounds the circumference of a heat-transfer tube due to retention of an evaporated and vaporized refrigerant in a liquid refrigerant. In general, a heat-transfer coefficient with gas is lower than a heat-transfer coefficient with a liquid, and thus dry out may deteriorate the heat-transfer performance of the evaporator.

Furthermore, in an evaporator, a phenomenon called carry over may occur, where liquid droplets of a refrigerant in evaporated refrigerant gas is discharged from the evaporator along with the refrigerant gas. If carry over occurs, refrigerant gas discharged from the evaporator enters a compressor, and liquid droplets in the refrigerant gas collide with an impeller of the compressor rotating at a high speed, which may lead to erosion of the impeller.

In the evaporator disclosed in Patent Document 2, a gap formed between an inner wall of the vessel and the heat-transfer tubes can be utilized as a passage for a liquid refrigerant to move down. However, in a case where a great amount of refrigerant gas is generated, dry out and carry over may still occur even if a refrigerant moves down through a passage formed between the inner wall of the vessel and the heat-transfer tubes. In particular, using refrigerant gas having a low vapor pressure may cause dry out and carry over. Thus, it is desirable to be able to suppress occurrence of dry out and carry over even in a case where a great amount of refrigerant gas is generated.

In view of the above issue, at least one embodiment of the present invention is to provide an evaporator which can suppress dry out of heat-transfer tubes and carry over of a refrigerant.

Solution to the Problems

The present inventors conducted extensive researches to prevent dry out and carry over. As a result, the inventors found that: (i) if there is locally no room for a liquid-phase refrigerant to escape when bubbles of a gas-phase refrigerant move up toward the surface of the liquid-phase refrigerant, the liquid refrigerant acts as a lid to trap the bubbles of the gas refrigerant under the surface of the liquid-phase refrigerant; (ii) accordingly, the gas-phase refrigerant is prevented from separating from the surface of the liquid-phase refrigerant, and retained bubbles of the gas-phase refrigerant surround the circumference of heat-transfer tubes; and (iii) due to the transient retention under the surface of the liquid-phase refrigerant, the gas-phase refrigerant is biased when separating from the surface of the liquid-phase refrigerant, thus causing entrainment of the liquid-phase refrigerant.

The present inventors conducted further researches on the basis of the above findings and arrived at the present invention described below.

(1) An evaporator according to at least one embodiment of the present invention comprises: a vessel having a refrigerant inlet for receiving a refrigerant at a lower part of the vessel, and a refrigerant outlet for discharging the refrigerant in an evaporated state at an upper part of the vessel; and a plurality of heat-transfer tubes disposed so as to extend inside the vessel along a longitudinal direction of the vessel, and configured to transfer heat received from a fluid flowing inside the heat-transfer tubes to the refrigerant flowing outside the heat-transfer tubes. The plurality of heat-transfer tubes are disposed so that at least one downward flow passage is defined through the plurality of heat-transfer tubes or around the plurality of heat-transfer tubes, the at least one downward flow passage having a width larger than a representative interval between the plurality of heat-transfer tubes. A representative interval between the plurality of heat-transfer tubes disposed on an upper side among the plurality of heat-transfer tubes is larger than a representative interval between the plurality of heat-transfer tubes disposed on a lower side among the plurality of heat-transfer tubes.

With the above configuration (1), the representative interval between the heat-transfer tubes on the upper side among the plurality of heat-transfer tubes is relatively wide, and thus the number density of bubbles of the gas-phase refrigerant is reduced near the surface of the liquid-phase refrigerant. Accordingly, room for escape is locally provided for the liquid-phase refrigerant, which prevents the liquid-phase refrigerant from being a lid to trap the gas-phase refrigerant. Thus, the gas-phase refrigerant smoothly separates from the surface of the liquid-phase refrigerant, which prevents retention of the gas-phase refrigerant under the surface of the liquid-phase refrigerant. As a result, it is possible to prevent heat-transfer tubes from being surrounded by the gas-phase refrigerant, thus preventing dry out, and to reduce the momentum of the gas-phase refrigerant upon separation, thus preventing carry over.

Furthermore, with the above configuration (1), the interval between the heat-transfer tubes on the upper side among the plurality of heat-transfer tubes is wider, and thereby the passage width for the gas-phase refrigerant to move upward is increased, and the ascending speed of the gas-phase refrigerant is reduced. This also reduces the momentum of the gas-phase refrigerant upon separation of the gas-phase refrigerant from the liquid-phase refrigerant, thus preventing carry over.

(2) In some embodiments, in the above described configuration (1) for instance, the at least one downward flow passage comprises a peripheral downward flow passage extending between an inner wall surface of the vessel and the plurality of heat-transfer tubes.

With the above configuration (2), it is possible to make use of the inner wall surface of the vessel of the evaporator to form a circulation passage.

(3) In some embodiments, in the above described configuration (1) for instance, the at least one downward flow passage comprises an intermediate downward flow passage extending in an upward-and-downward direction through the plurality of heat-transfer tubes.

With the above configuration (3), the downward flow passage is formed through the plurality of heat-transfer tubes, and thus it is possible to circulate the liquid-phase refrigerant smoothly in the vessel. As a result, an excellent heat-exchange performance can be achieved.

(4) In some embodiments, in any one of the above described configurations (1) to (3) for instance, the at least one downward flow passage has a width which reaches its maximum in an uppermost part of the at least one downward flow passage, in a transverse cross section taken orthogonal to the longitudinal direction of the vessel.

With the above configuration (4), the width of the downward flow passage is the largest in the uppermost part, and thereby the liquid-phase refrigerant separated from the gas-phase refrigerant can enter the downward flow passage smoothly at the surface of the liquid-phase refrigerant. Thus, the liquid-phase refrigerant smoothly circulates inside the vessel, and thereby an excellent heat-exchange performance can be achieved.

(5) In some embodiments, in any one of the above described configurations (1) to (3) for instance, the at least one downward flow passage has a width which increases gradually downward, in a transverse cross section taken orthogonal to the longitudinal direction of the vessel.

With the above configuration (5), the width of the downward flow passage gradually increases downward, which makes it easier for the liquid-phase refrigerant to move downward, and thereby it is possible to circulate the liquid-phase refrigerant more smoothly inside the vessel.

(6) In some embodiments, in any one of the above described configurations (1) to (5) for instance, the plurality of heat-transfer tubes includes a plurality of upper heat-transfer tubes disposed on an upper side and a plurality of lower heat-transfer tubes disposed on a lower side. The plurality of upper heat-transfer tubes are disposed so that at least one upward flow passage is defined through the plurality of upper heat-transfer tubes, the at least one upward flow passage having a width larger than a representative interval between the plurality of upper heat-transfer tubes.

With the above configuration (6), the plurality of upper heat-transfer tubes are disposed so that at least one upward flow passage is defined through the plurality of upper heat-transfer tubes, the upward flow passage having a width wider than the representative interval between the heat-transfer tubes, and thereby the gas-phase refrigerant generated by evaporation can move upward smoothly to the surface of the liquid-phase refrigerant through the upward flow passage. As a result, the gas-phase refrigerant smoothly separates from the surface of the liquid-phase refrigerant, which prevents retention of the gas-phase refrigerant under the surface of the liquid-phase refrigerant. Accordingly, it is possible to prevent dry out, and to reduce the momentum of the gas-phase refrigerant upon separation, thus preventing carry over.

(7) In some embodiments, in any one of the above described configurations (1) to (6) for instance, the evaporator further comprises a partition plate disposed between the refrigerant inlet and a lower opening of the at least one downward flow passage.

With the above configuration (7), the partition plate is disposed between the refrigerant inlet and the lower opening of the at least one downward flow passage, and thereby a flow of the refrigerant entering from the refrigerant inlet does not interfere with the downward flow of the liquid-phase refrigerant in the downward flow passage. Thus, the liquid-phase refrigerant smoothly circulates inside the vessel, and thereby an excellent heat-exchange performance can be ensured.

(8) In some embodiments, in the above configuration (7) for instance, the partition plate extends between the refrigerant inlet and the plurality of heat-transfer tubes, and has a plurality of through holes at least in a region facing the plurality of heat-transfer tubes.

With the above configuration (8), the partition plate has the plurality of through holes at least in a region facing the plurality of heat-transfer tubes, and thereby it is possible to supply the heat-transfer tubes with the refrigerant supplied from the refrigerant inlet through the through holes. Thus, it is possible to improve the heat-exchange efficiency of the evaporator.

(9) In some embodiments, in the above configuration (8) for instance, the vessel has an inlet of the fluid on one end side in the longitudinal direction of the vessel. The partition plate has an inlet vicinity region disposed on a side of the inlet of the fluid, and an inlet remote region disposed remote from the inlet of the fluid, in the longitudinal direction of the vessel. A flow-path area defined by the plurality of through holes in the inlet vicinity region of the partition plate is greater than a flow-path area defined by the plurality of through holes in the inlet remote region of the partition plate.

A fluid that flows inside the heat-transfer tubes has the highest temperature in a part where the fluid is supplied to the heat-transfer tubes, that is, an inlet side of the fluid in the longitudinal direction of the vessel. Accordingly, the temperature difference between a refrigerant inside the vessel and a fluid that flows inside the heat-transfer tubes is greatest at the inlet side of the fluid in the longitudinal direction of the vessel.

With the above configuration (9), the flow-path area defined by the through holes in the vicinity of the inlet, on the partition plate, is relatively greater than the flow-path area defined by the through holes remote from the inlet, and thereby it is possible to supply more refrigerant to a region where the temperature difference between inside and outside the heat-transfer tubes is greatest. Thus, it is possible to improve the heat-exchange efficiency of the evaporator.

(10) In some embodiments, in the above configuration (8) or (9), a diameter of the through holes is smaller in the inlet vicinity region of the partition plate than in the inlet remote region of the partition plate.

If a partition plate having through holes formed thereon is placed in a refrigerant in a gas-liquid mixed state, through holes with a larger diameter are more likely to let through bubbles of a gas-phased refrigerant. Furthermore, through holes having a relatively small diameter are less likely to let through bubbles of a gas-phase refrigerant, but more likely to let through a liquid-phase refrigerant.

Thus, with the above configuration (10), the diameter of the through holes in the vicinity of the inlet on the partition plate is smaller than that of the through holes remote from the inlet. Thus, if the refrigerant supplied to the refrigerant inlet is in a gas-liquid mixed state, a relatively larger amount of liquid-phase refrigerant is supplied to the region where the temperature difference between inside and outside the heat-transfer tubes is greatest. A liquid-phase refrigerant has a higher heat-transfer coefficient than a gas-phase refrigerant. With the above configuration, a liquid-phase refrigerant, which has a high heat-transfer coefficient, is supplied to a region where the temperature difference between inside and outside the heat-transfer tubes is greatest, and thereby it is possible to improve the heat-exchange efficiency of the evaporator.

(11) In some embodiments, in any one of the above described configurations (8) to (10) for instance, the number per unit area of the plurality of through holes is greater in the inlet vicinity region of the partition plate than in the inlet remote region.

With the above configuration (11), the number per unit area of the plurality of through holes is greater in an inlet vicinity side than in an inlet remote side on the partition plate, and thereby it is possible to supply the heat-transfer tubes with a larger amount of refrigerant in a region where the temperature difference between the refrigerant inside the vessel and the fluid flowing through the heat-transfer tubes is greatest. Accordingly, it is possible to improve the heat-exchange performance of the evaporator.

(12) In some embodiments, in any one of the above described configurations (1) to (11), the evaporator further comprises a support plate which has a plurality of through holes into which the plurality of heat-transfer tubes are inserted, and which is disposed so as to divide an inside of the vessel into a plurality of sections in the longitudinal direction of the vessel, while supporting the plurality of heat-transfer tubes. The support plate further includes an axial hole for letting through the refrigerant.

With the above configuration (12), a support plate is provided, which has a plurality of axial holes for letting through the refrigerant and which is disposed so as to divide the inside of the vessel into a plurality of sections, and thereby the refrigerant can move freely through the axial holes. Thus, if different amounts of gas-phase refrigerant are generated between adjacent sections, for instance, to cause variation in the hydraulic head pressure, the liquid-phase refrigerant can transfer through the axial holes in accordance with the variation, which makes it possible to improve the heat-exchange efficiency of the evaporator.

(13) In some embodiments, in any one of the above described configurations (1) to (12), the refrigerant has a saturated pressure of not more than 0.2 MPa (G) at a temperature of 38° C.

When liquid refrigerants having the same mass and different saturated vapor pressures are evaporated, the refrigerant having a lower saturated vapor pressure turns into steam of a larger volume than the refrigerant having a higher saturated vapor pressure. Accordingly, if a refrigerant having a relatively low saturated vapor pressure is evaporated, a larger amount of gas-phase refrigerant is produced to exist in a liquid-phase refrigerant, which increases the risk of dry out around the heat-transfer tubes and carry over of the refrigerant. Thus, if a refrigerant having a relatively low saturated vapor pressure is to be used, it is especially important to suppress dry out and carry over.

With the above configuration (13), even if a refrigerant having a relatively low saturated vapor pressure is used, it is possible to suppress dry out and carry over.

Furthermore, in some embodiments, in any one of the above described configurations (1) to (12), the refrigerant has a saturated pressure of not less than 0.0 MPa (G) and not more than 0.2 MPa (G) at a temperature of 38° C.

(14) In some embodiments, in any one of the above described configurations (1) to (13), the vessel has a header section on at least one end side in the longitudinal direction of the vessel, the header section having an inlet-side space communicating with an inlet of the fluid and an outlet-side space communicating with an outlet of the fluid. The heat-transfer tubes include: an inlet-side heat-transfer tube connected to the inlet-side space; and an outlet-side heat-transfer tube connected to the outlet-side space. The inlet-side heat-transfer tube and the outlet-side heat-transfer tube are disposed so as to be separated on opposite sides in a width direction of the vessel.

(15) A refrigerator according to at least one embodiment of the present invention comprises: a compressor for compressing a refrigerant; a condenser for condensing the refrigerant compressed by the compressor; an expander for expanding the refrigerant condensed by the condenser; and an evaporator for evaporating the refrigerant expanded by the expander. The evaporator is the evaporator according to any one of the above (1) to (14).

With the above configuration (15), the representative interval between the heat-transfer tubes on the upper side among the plurality of heat-transfer tubes is relatively wide, and thus the number density of bubbles of the gas-phase refrigerant is reduced near the surface of the liquid-phase refrigerant. Accordingly, room for escape is locally provided for the liquid-phase refrigerant, which prevents the liquid-phase refrigerant from being a lid to trap the gas-phase refrigerant. Thus, the gas-phase refrigerant smoothly separates from the surface of the liquid-phase refrigerant, which prevents retention of the gas-phase refrigerant under the surface of the liquid-phase refrigerant. As a result, it is possible to prevent the heat-transfer tubes from being surrounded by the gas-phase refrigerant, thus preventing dry out, and to reduce the momentum of the gas-phase refrigerant upon separation, thus preventing carry over.

Furthermore, with the above configuration (15), the interval between the heat-transfer tubes on the upper side among the plurality of heat-transfer tubes is wider, and thereby the passage width for the gas-phase refrigerant to move upward is increased, and the ascending speed of the gas-phase refrigerant is reduced. This also reduces the momentum of the gas-phase refrigerant upon separation of the gas-phase refrigerant from the liquid-phase refrigerant, thus preventing carry over.

Advantageous Effects

According to at least one embodiment of the present invention, provided is an evaporator which can suppress dry out of heat-transfer tubes and carry over of a refrigerant.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
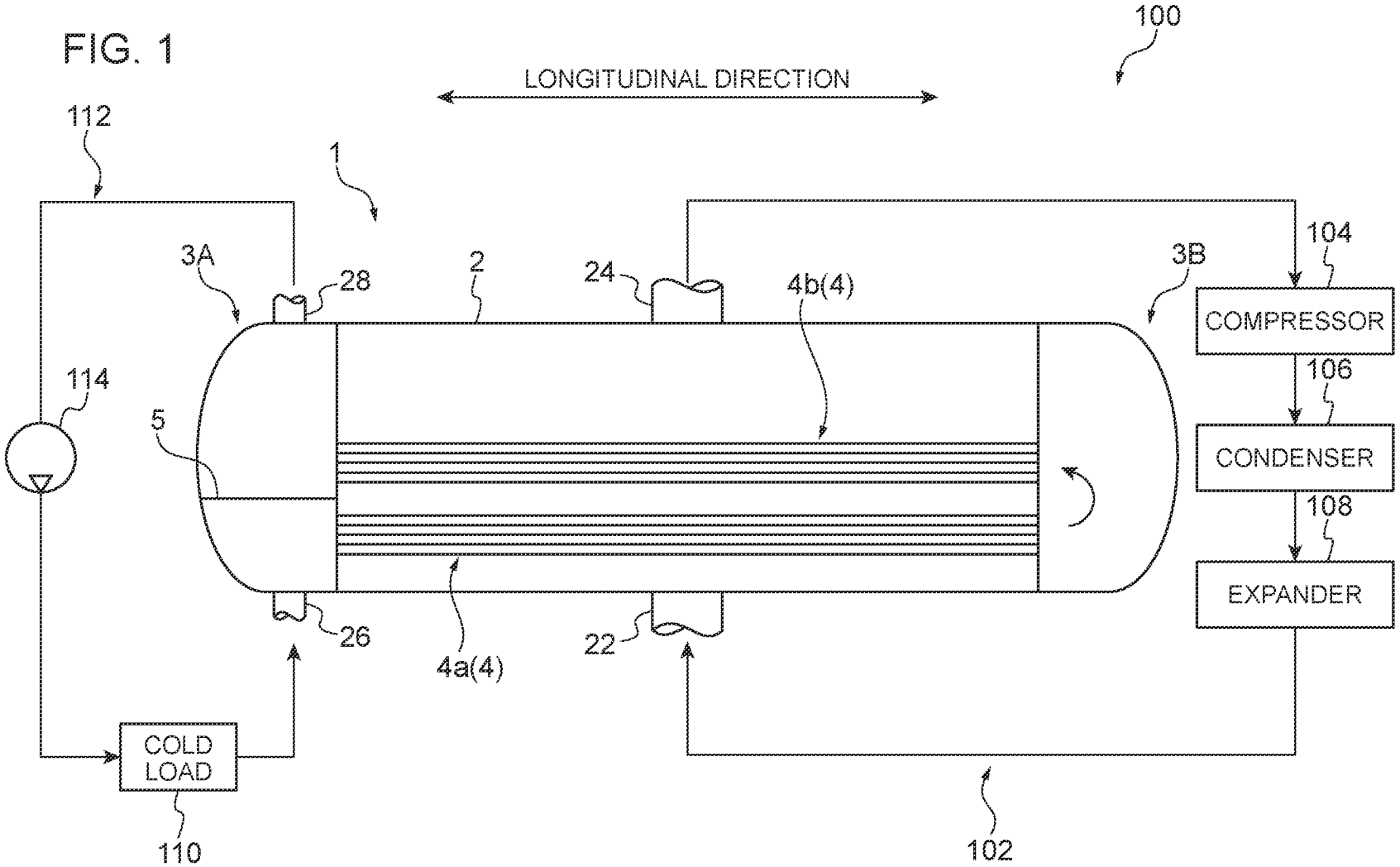
FIG. 1 is a schematic configuration diagram of a refrigerator and an evaporator according to an embodiment.
Figure 2:
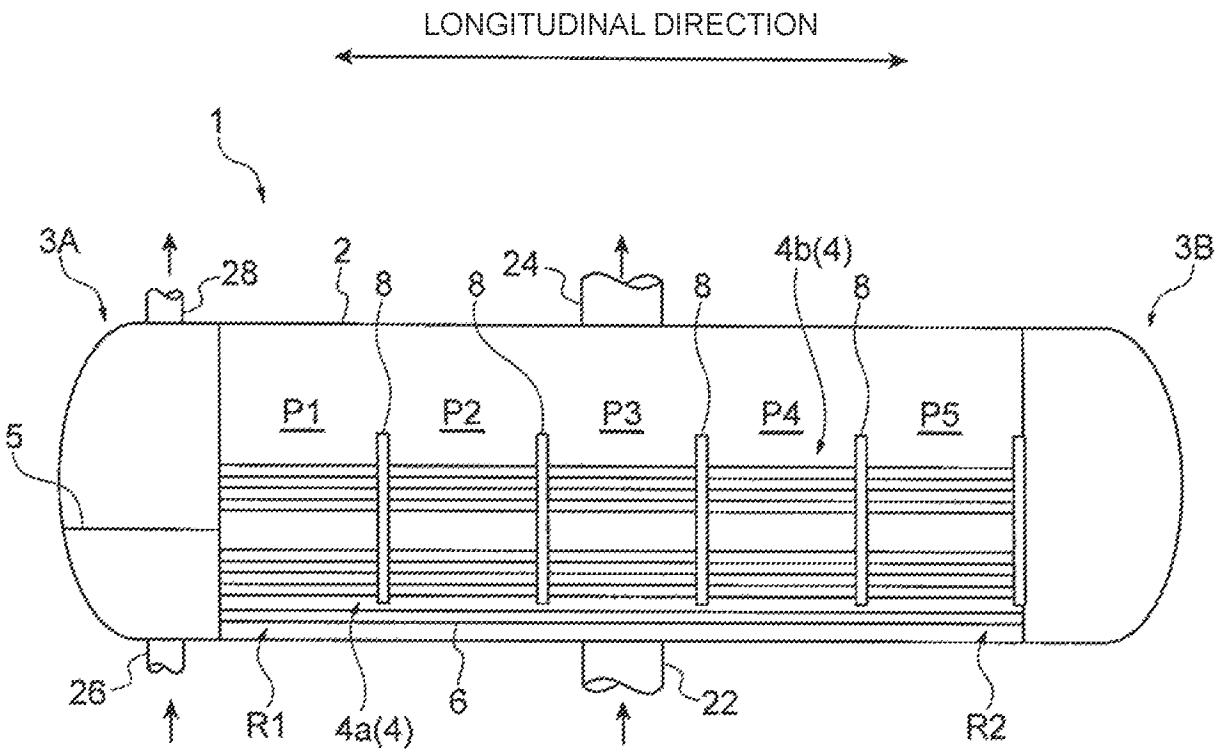
FIG. 2 is a schematic configuration diagram of an evaporator according to an embodiment.

With reference to FIGS. 1 and 2, an overview of an evaporator according to an embodiment of the present invention will now be described. FIGS. 1 and 2 are each a schematic configuration diagram of an evaporator according to an embodiment.

An evaporator 1 depicted in FIGS. 1 and 2 includes a vessel 2, and a plurality of heat-transfer tubes 4 extending inside the vessel 2 along a longitudinal direction of the vessel 2.

The vessel 2 has a refrigerant inlet 22 for receiving a refrigerant at a lower part of the vessel 2, and a refrigerant outlet 24 for discharging the refrigerant at an upper part of the vessel 2. The plurality of heat-transfer tubes 4 is configured to receive heat from a fluid flowing inside the heat-transfer tubes 4 and transfer the heat to the refrigerant flowing outside the heat-transfer tubes 4 inside the vessel 2.

Header sections 3A, 3B are disposed on opposite end portions of the vessel 2 in the longitudinal direction, and the plurality of heat-transfer tubes 4 is disposed in an intermediate section of the vessel 2 separated from the header sections 3A, 3B by partition walls. The opposite ends of each of the plurality of heat-transfer tubes 4 are connected to the header sections 3A, 3B, and thereby a fluid is supplied to each of the heat-transfer tubes 4 via the header sections 3A, 3B.

More specifically, the header section 3A disposed on one end side of the vessel 2 in the longitudinal direction of the vessel 2 has a fluid inlet 26 and a fluid outlet 28, and the inside of the header section 3A is divided into a space on the side of the fluid inlet 26 (inlet-side space) and a space on the side of the fluid outlet 28 (outlet-side space) by a division wall 5.

Among the plurality of heat-transfer tubes 4, some heat-transfer tubes 4*a* have an end connected to the inlet-side space of the header section 3A, and the rest of the heat-transfer tubes 4*b* have an end connected to the outlet-side space of the header section 3A. The other ends of both of the heat-transfer tubes 4*a* and the heat-transfer tubes 4*b* are connected to the header section 3B.

In this case, a fluid is supplied to the heat-transfer tubes 4*a* via the inlet-side space, flows through the heat-transfer tubes 4*a* to reach the other end side in the longitudinal direction, and enters the header section 3B. The fluid having entered the header section 3B flows into the outlet-side space through the heat-transfer tubes 4*b* to be discharged outside the evaporator 1 through the fluid outlet 28.

An overview of operation for evaporating a refrigerant with the evaporator 1 having the above configuration will be described below.

A refrigerant in a liquid state, or a refrigerant in a liquid state contained in a gas-liquid mixed refrigerant (liquid-phase refrigerant), is taken into the vessel 2 via the refrigerant inlet 22. Inside the vessel 2, the liquid-phase refrigerant evaporates by exchanging heat with the fluid flowing inside the heat-transfer tubes 4 via the heat-transfer tubes 4. The refrigerant having evaporated and turned into a gas state (gas-phase refrigerant) separates from the surface of the heat-transfer tubes 4 to move upward through the liquid-phase refrigerant, and separates from the surface of the liquid-phase refrigerant. The gas-phase refrigerant having separated from the surface of the liquid-phase refrigerant gets discharged from the vessel 2 via the refrigerant outlet 24.

The fluid to flow inside the plurality of heat-transfer tubes 4 is not particularly limited. For instance, water or air can be used as the fluid. To evaporate the refrigerant by heat exchange, the fluid needs to have a temperature higher than the boiling point of the refrigerant at the pressure inside the vessel 2 in operation, when supplied to the heat-transfer tubes 4.

In an embodiment, the evaporator 1 is included in the refrigerator 100, as depicted in FIG. 1. The refrigerator 100 depicted in FIG. 1 includes a compressor 104 for compressing a refrigerant, a condenser 106 for condensing the refrigerant compressed by the compressor 104, an expander 108 for expanding the refrigerant condensed by the condenser 106, and the evaporator 1 for evaporating the refrigerant expanded by the expander 108. The compressor 104, the condenser 106, the expander 108, and the evaporator 1 are connected via a refrigerant line 102 so that the refrigerant flowing through the refrigerant line 102 passes in this order.

Furthermore, in an embodiment, the fluid outlet 28 and the fluid inlet 26 of the evaporator 1 are connected to each other via a fluid line 112, as depicted in FIG. 1. The evaporator 1 is configured such that the fluid, discharged from the fluid outlet 28 after having exchanged heat with the refrigerant at the heat-transfer tubes 4, transfers cold to a cold load 110 in the fluid line 112 to cool the cold load 110, before returning to the fluid inlet 26. The fluid returned to the fluid inlet 26 is supplied again to the heat-transfer tubes 4 for heat exchange with the refrigerant. A pump 114 may be disposed in the fluid line 112 to make the fluid flow smoothly through the fluid line 112.

In an exemplary embodiment depicted in FIG. 2, the evaporator 1 further includes a partition plate 6 disposed between the refrigerant inlet 22 and a lower opening of a downward flow passage described below.

Furthermore, in the exemplary embodiment depicted in FIG. 2, the evaporator 1 further includes a support plate 8 disposed so as to divide the inside of the vessel 2 into a plurality of sections in the longitudinal direction of the vessel 2, while supporting the plurality of heat-transfer tubes 4. The support plate 8 has a plurality of through holes into which the plurality of heat-transfer tubes 4 are inserted.

In some embodiments, the evaporator 1 may include only one of the partition plate 6 or the support plate 8. In some embodiments, the evaporator 1 may include both of the partition plate 6 and the support plate 8.

The partition plate 6 and the support plate 8 will be described later in detail.

Figure 10:
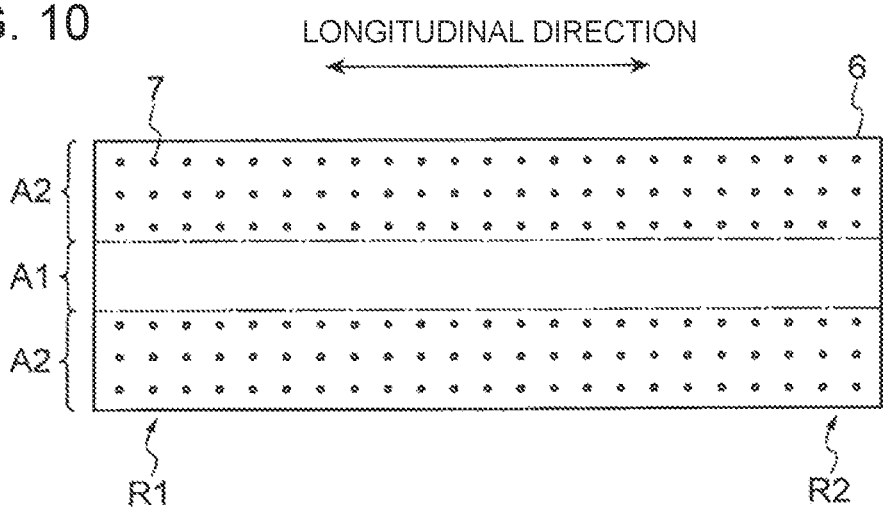
FIG. 10 is a schematic planar view of a partition plate according to an embodiment.
Figure 11:
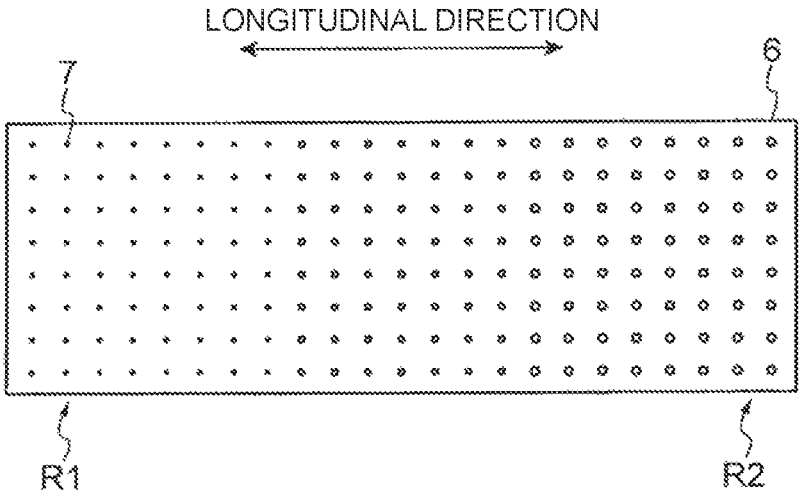
FIG. 11 is a schematic planar view of a partition plate according to an embodiment.
Figure 12:
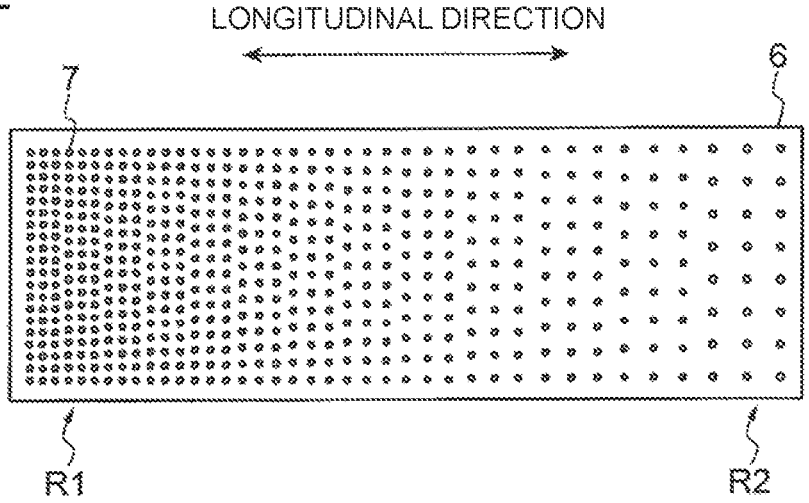
FIG. 12 is a schematic planar view of a partition plate according to an embodiment.

Next, with reference to FIGS. 3 to 12, a configuration of an evaporator according to an embodiment will be described in more detail. FIGS. 3 to 9 are each a schematic transverse cross-sectional view of an evaporator according to an embodiment. FIGS. 10 to 12 are each a schematic planar view of a partition plate according to an embodiment.

In the exemplary embodiments depicted in FIGS. 3 to 9, the plurality of heat-transfer tubes 4 is disposed so that at least one downward flow passage 32 is defined through or around the plurality of heat-transfer tubes 4. The downward flow passage 32 has a width wider than a representative interval between the plurality of heat-transfer tubes 4, such as intervals d1 and d2 described below. The width of the downward flow passage 32 is, for instance, widths D1 to D11 in the drawings. Furthermore, the representative interval d1 between the plurality of heat-transfer tubes 4 disposed on the upper side among the plurality of heat-transfer tubes 4 is wider than the representative interval d2 between the plurality of heat-transfer tubes 4 disposed on the lower side among the plurality of heat-transfer tubes 4.

Here, a representative interval between heat-transfer tubes refers to an interval between heat-transfer tubes disposed at substantially regular interval at least in a partial region, excluding an interval between heat-transfer tubes across a downward flow passage in a case where a downward flow passage is formed through the plurality of heat-transfer tubes.

Figure 3:
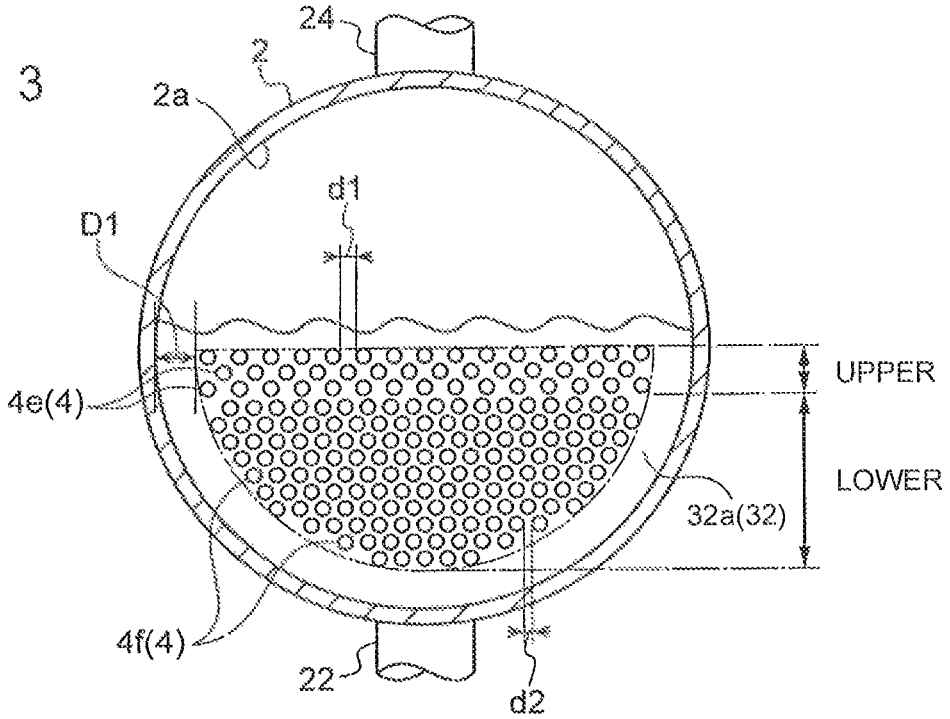
FIG. 3 is a schematic transverse cross-sectional view of an evaporator according to an embodiment.

For instance, in the embodiment depicted in FIG. 3, at least one downward flow passage 32 includes a peripheral downward flow passage 32*a* extending between an inner wall surface 2*a* of the vessel 2 and the plurality of heat-transfer tubes 4. Also in the embodiments depicted in FIGS. 4, 5, 8 and 9, the downward flow passage 32 includes a peripheral downward flow passage 32*a* extending between the inner wall surface 2*a* of the vessel 2 and the plurality of heat-transfer tubes 4.

Furthermore, the width D1 of the downward flow passage 32 is wider than the representative intervals between the heat-transfer tubes 4, i.e., the representative interval d1 between the heat-transfer tubes 4 disposed on the upper side and the representative interval d2 between the heat-transfer tubes 4 disposed on the lower side, among the plurality of heat-transfer tubes 4. Moreover, the interval d1 is wider than the interval d2.

In the evaporator 1 according to the above embodiment, the representative interval d1 between the heat-transfer tubes 4 on the upper side among the plurality of heat-transfer tubes 4 is relatively wider than the interval d2, and thus the number density of bubbles of the gas-phase refrigerant is reduced near the surface of the liquid-phase refrigerant. Accordingly, room for escape is locally provided for the liquid-phase refrigerant, which prevents the liquid-phase refrigerant from being a lid to trap the gas-phase refrigerant. Thus, the gas-phase refrigerant smoothly separates from the surface of the liquid-phase refrigerant, which prevents retention of the gas-phase refrigerant under the surface of the liquid-phase refrigerant. As a result, it is possible to prevent the heat-transfer tubes 4 from being surrounded by the gas-phase refrigerant, thus preventing dry out, and to reduce the momentum of the gas-phase refrigerant upon separation, thus preventing carry over.

Furthermore, in the evaporator 1 according to the above embodiment, the interval d1 between the heat-transfer tubes 4 on the upper side among the plurality of heat-transfer tubes 4 is wider, and thereby the passage width for the gas-phase refrigerant to move upward is increased, and the ascending speed of the gas-phase refrigerant is reduced. This also reduces the momentum of the gas-phase refrigerant upon separation of the gas-phase refrigerant from the liquid-phase refrigerant, thus preventing carry over.

Figure 6:
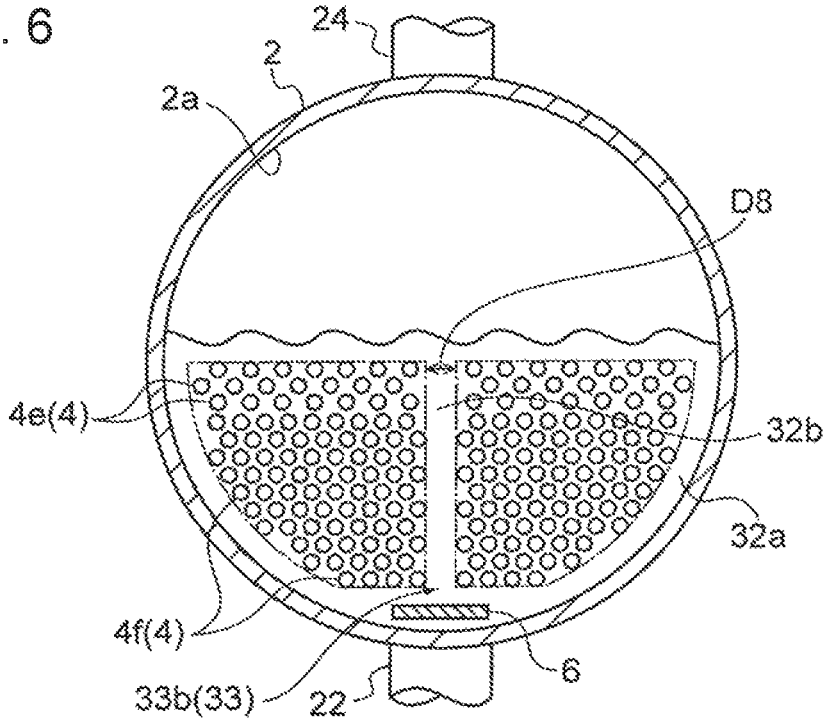
FIG. 6 is a schematic transverse cross-sectional view of an evaporator according to an embodiment.
Figure 7:
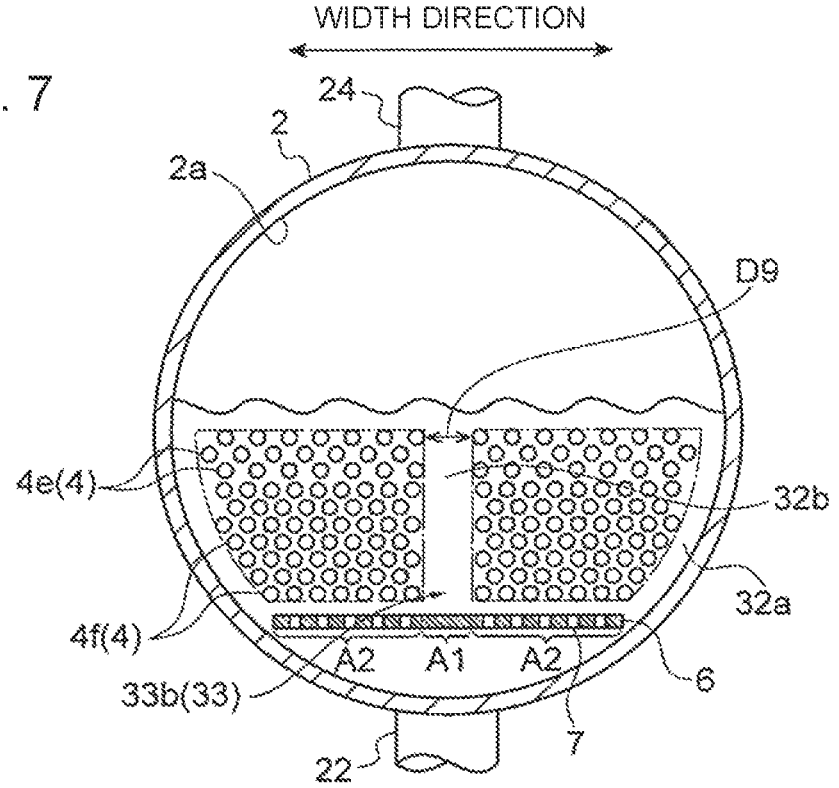
FIG. 7 is a schematic transverse cross-sectional view of an evaporator according to an embodiment.

In some embodiments, as depicted in FIG. 6 or 7, the at least one downward flow passage 32 includes an intermediate downward flow passage 32*b* extending along an upward-and-downward direction through the plurality of heat-transfer tubes 4.

In some embodiments, the at least one downward flow passage 32 may include only one of the peripheral downward flow passage 32*a* or the intermediate downward flow passage 32*b*. In some embodiments, the at least one downward flow passage 32 may include both of the peripheral downward flow passage 32*a* and the intermediate downward flow passage 32*b*.

Figure 4:
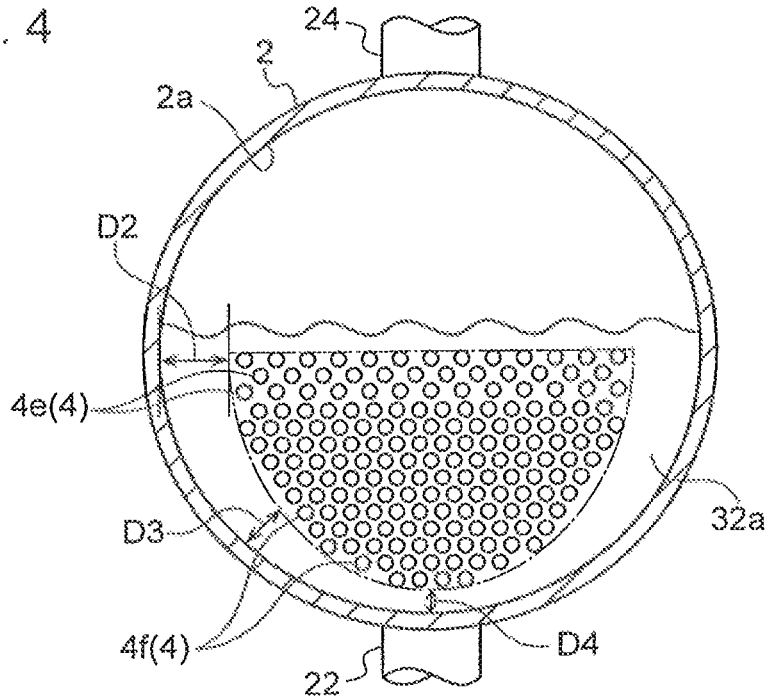
FIG. 4 is a schematic transverse cross-sectional view of an evaporator according to an embodiment.

In the exemplary embodiment depicted in FIG. 4, the downward flow passage 32, that is, the peripheral downward flow passage 32*a*, has the widest width D2 in the uppermost part of the peripheral downward flow passage 32*a*, in a transverse cross section taken orthogonal to the longitudinal direction of the vessel 2. In other words, the width D2 in the uppermost part of the peripheral downward flow passage 32*a* is wider than the width D3 and the width D4 below the width D2.

Accordingly, the width of the downward flow passage 32 is the largest at the uppermost part, and thereby the liquid-phase refrigerant separated from the gas-phase refrigerant can enter the downward flow passage smoothly at the surface of the liquid-phase refrigerant. Thus, the liquid-phase refrigerant smoothly circulates inside the vessel 2, and thereby an excellent heat-exchange performance can be achieved.

Figure 5:
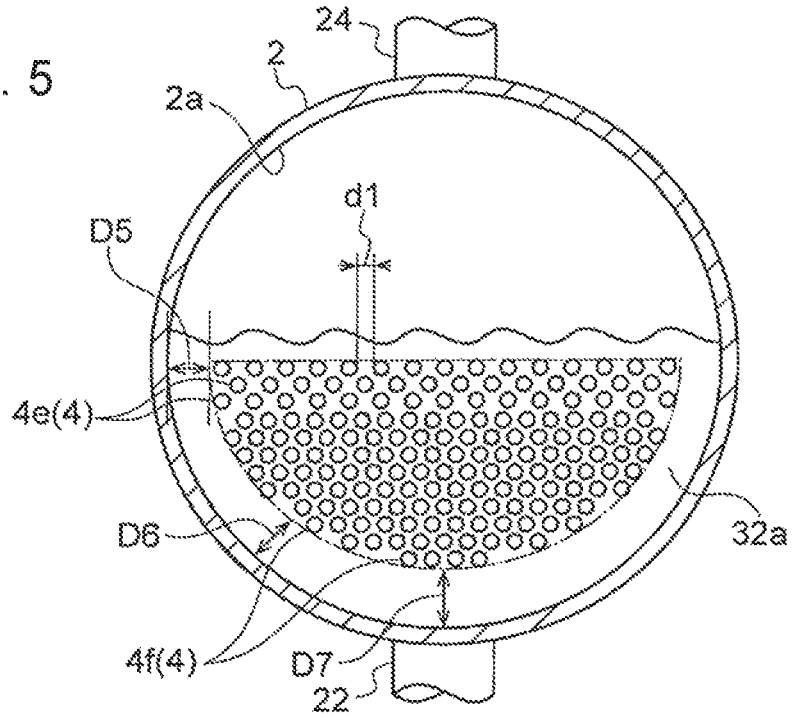
FIG. 5 is a schematic transverse cross-sectional view of an evaporator according to an embodiment.

In the embodiment depicted in FIG. 5, the downward flow passage 32, that is, the peripheral downward flow passage 32*a*, has a width that increases gradually downward in a transverse cross section (depicted in FIG. 5) taken orthogonal to the longitudinal direction of the vessel 2. In other words, widths D5 to D7 satisfy a relationship of D5≤D6≤D7, where D5, D6, and D7 are the widths of the peripheral downward flow passage 32*a* at the uppermost part, at an intermediate position between the uppermost part and the lowermost part, and at the lowermost part, respectively.

Accordingly, the width of the downward flow passage 32 gradually increases downward, which makes it easier for the liquid-phase refrigerant to move downward, and thereby it is possible to circulate the liquid-phase refrigerant more smoothly inside the vessel 2.

Figure 8:
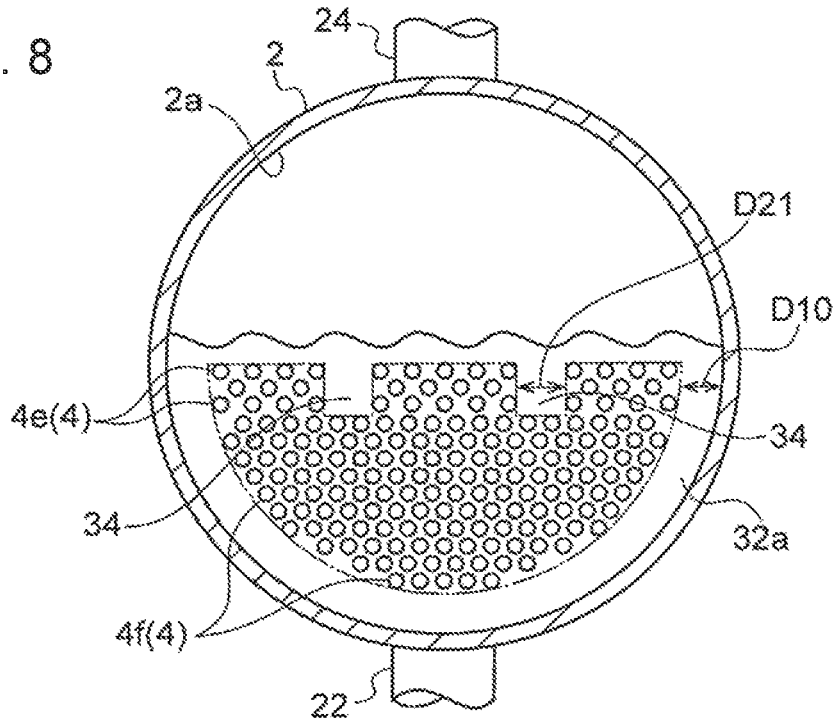
FIG. 8 is a schematic transverse cross-sectional view of an evaporator according to an embodiment.

In the exemplary embodiment depicted in FIG. 8, the plurality of heat-transfer tubes 4 includes a plurality of upper heat-transfer tubes 4*e* disposed on the upper side, and a plurality of heat-transfer tubes 4*f* disposed on the lower side. Furthermore, the plurality of upper heat-transfer tubes 4*e* are disposed so that at least one upward flow passage 34 is defined through the plurality of upper heat-transfer tubes 4*e*, the upward flow passage 34 having a width D21 wider than the representative interval d1 between the heat-transfer tubes 4*e*.

Accordingly, the plurality of upper heat-transfer tubes 4*e* are disposed so that the at least one upward flow passage 34 is defined through the plurality of upper heat-transfer tubes 4*e*, the upward flow passage 34 having a width D21 wider than the representative interval d1 between the heat-transfer tubes 4*e*, and thereby the gas-phase refrigerant generated by evaporation can move upward smoothly to the surface of the liquid-phase refrigerant through the upward flow passage. As a result, the gas-phase refrigerant smoothly separates from the surface of the liquid-phase refrigerant, which prevents retention of the gas-phase refrigerant under the surface of the liquid-phase refrigerant. Accordingly, it is possible to prevent dry out, and to reduce the momentum of the gas-phase refrigerant upon separation, thus preventing carry over.

In the embodiment depicted in FIG. 8, the wider the width of the upward flow passage 34 is, the smoother the upward movement of the gas-phase refrigerant is likely to be in the upward flow passage 34. Thus, the gas-phase refrigerant smoothly separates from the surface of the liquid-phase refrigerant, which makes it less likely for the gas-phase refrigerant to be retained under the surface of the liquid-phase refrigerant. Accordingly, it is possible to enhance the effect to prevent dry out, and to prevent carry over by reducing the momentum of the gas-phase refrigerant upon separation.

In the exemplary embodiments depicted in FIGS. 6 and 7, the evaporator 1 further includes a partition plate 6 disposed between the refrigerant inlet 22 and a lower opening 33 of the at least one downward flow passage 32. In these embodiments, the partition plate 6 is disposed between the refrigerant inlet 22 and the lower opening 33*b* of the intermediate downward flow passage 32*b*.

As described above, the partition plate 6 is disposed between the refrigerant inlet 22 and the lower opening 33 of the at least one downward flow passage 32, and thereby a flow of refrigerant entering from the refrigerant inlet 22 does not interfere with the downward flow of the liquid-phase refrigerant in the downward flow passage 32. Thus, the liquid-phase refrigerant smoothly circulates inside the vessel 2, and thereby an excellent heat-exchange performance can be ensured.

Now, FIG. 10 is a planar view of the partition plate 6 according to an embodiment depicted in FIG. 7.

In the exemplary embodiment depicted in FIG. 7, the partition plate 6 extends between the refrigerant inlet 22 and the plurality of heat-transfer tubes 4. Specifically, the partition plate 6 extends along the width direction and the longitudinal direction of the vessel 2 between the refrigerant inlet 22 and the plurality of heat-transfer tubes 4. Furthermore, as depicted in FIGS. 7 and 10, the partition plate 6 has a plurality of through holes 7 at least in region A2 that faces the plurality of heat-transfer tubes 4.

With the partition plate 6 having the plurality of through holes 7 at least in region A2 facing the plurality of heat-transfer tubes 4, it is possible to supply the heat-transfer tubes 4 with the refrigerant supplied from the refrigerant inlet 22 through the through holes 7. Thus, it is possible to ensure an excellent heat-exchange efficiency for the evaporator 1.

Region A1 in FIGS. 7 and 10 is a region, on the partition plate 6, that faces the lower opening 33 of the downward flow passage 32. In the embodiment depicted in FIG. 7, the partition plate 6 does not have through holes for letting through the refrigerant supplied from the refrigerant inlet 22 in region A1 facing the lower opening 33*b* of the downward flow passage 32, that is, the lower opening 33*b* of the intermediate downward flow passage 32*b*. Accordingly, a flow of the refrigerant entering from the refrigerant inlet 22 does not interfere with the downward flow of the liquid-phase refrigerant in the downward flow passage 32. Thus, the liquid-phase refrigerant smoothly circulates inside the vessel 2, and thereby an excellent heat-exchange performance can be ensured.

Meanwhile, in some embodiments, as depicted in FIG. 2, the vessel 2 has the fluid inlet 26 on one end side in the longitudinal direction of the vessel 2, and a fluid is fed into the heat-transfer tubes 4 via the fluid inlet 26. The partition plate 6 has an inlet vicinity region R1 disposed on the side of the fluid inlet 26 in the longitudinal direction of the vessel 2, and an inlet remote region R2 disposed remote from the fluid inlet 26.

In some embodiments, a flow path area defined by a plurality of through holes 7 in the inlet vicinity region R1 of the partition plate 6 is greater than a flow-path area defined by a plurality of through holes 7 in the inlet remote region R2 of the partition plate 6.

Accordingly, the flow-path area defined by the through holes 7 in the vicinity of the inlet, on the partition plate 6, is relatively greater than the flow-path area defined by the through holes 7 remote from the inlet, and thereby it is possible to supply more refrigerant to a region in the vicinity of the inlet, where the temperature difference between inside and outside the heat-transfer tubes 4 is normally greatest. Thus, it is possible to improve the heat-exchange efficiency of the evaporator 1.

In some embodiments, for instance, the partition plate depicted in FIG. 11 or 12 is used as the above specified partition plate 6.

On the partition plate 6 depicted in FIG. 11, the diameter of the through holes 7 in the inlet vicinity region R1 is smaller than the diameter of the through holes 7 in the inlet remote region R2.

For instance, the diameter of the through holes 7 in the inlet vicinity region R1 is within a range of at least about 1/10 and at most about 10 times the diameter of the through holes 7 in the inlet remote region R2. Furthermore, the number, position, and thickness of the holes may also be changed for adjustment.

Through holes having a relatively large diameter are more likely to let through bubbles of the gas-phase refrigerant. Furthermore, through holes having a relatively small diameter are less likely to let through bubbles of the gas-phase refrigerant, but more likely to let through the liquid-phase refrigerant. With the above configuration, if the refrigerant supplied to the refrigerant inlet 22 is in a gas-liquid mixed state, it is possible to supply a relatively larger amount of the liquid-phase refrigerant, which has a relatively high heat-transfer efficiency, to the inlet vicinity region R1, where the temperature difference between inside and outside the heat-transfer tubes 4 is normally greatest. Thus, it is possible to improve the heat-exchange efficiency of the evaporator 1.

Furthermore, in the case of the partition plate 6 depicted in FIG. 11, the diameter of the plurality of through holes 7 on the partition plate 6 is the minimum at the side closest to the inlet on the partition plate 6, gradually increasing toward the side remote from the inlet to reach its maximum at the side farthest from the inlet.

On the partition plate 6 depicted in FIG. 12, the number per unit area of the through holes 7 in the inlet vicinity region R1 is greater than that in the inlet remote region R2. Specifically, on the partition plate 6 depicted in FIG. 12, the diameter of the plurality of through holes 7 is substantially constant in the longitudinal direction, but the distance between adjacent through holes 7 is smaller in the inlet vicinity region R1 than in the inlet remote region R2, whereby the number per unit area of the through holes 7 (number density) is greater in the inlet vicinity region R1 than in the inlet remote region R2.

With the above configuration, it is possible to supply the heat-transfer tubes 4 with a larger amount of refrigerant in the inlet vicinity region R1, where the temperature difference between the refrigerant inside the vessel 2 and the fluid flowing through the heat-transfer tubes 4 is normally greatest. Accordingly, it is possible to improve the heat-exchange performance of the evaporator 1.

Figure 9:
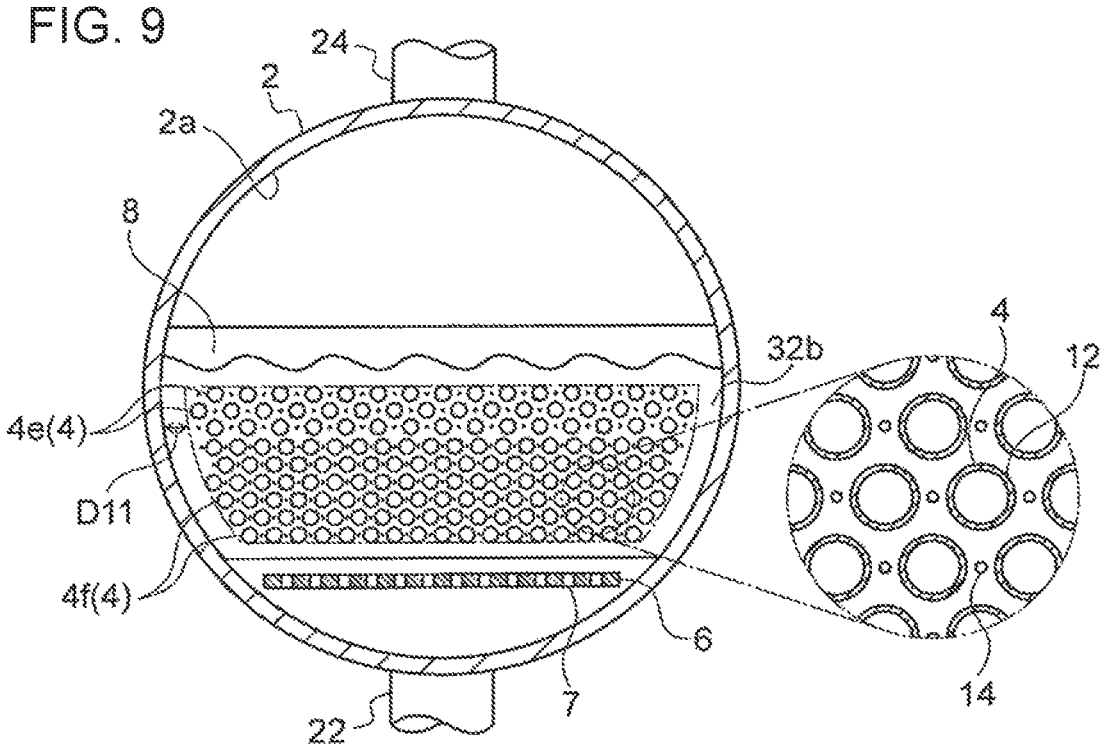
FIG. 9 is a schematic transverse cross-sectional view of an evaporator according to an embodiment.

The evaporator 1 according to the embodiment depicted in FIG. 9 includes the support plate 8. The support plate 8 has a plurality of through holes 12 into which the plurality of heat-transfer tubes 4 are inserted. The support plate 8 is disposed so as to divide the inside of the vessel 2 into a plurality of sections in the longitudinal direction of the vessel 2 while supporting the plurality of heat-transfer tubes 4 as depicted in FIG. 2. For instance, in FIG. 2, a plurality of support plates 8 is disposed so as to divide the inside of the vessel 2 into five sections P1 to P5. Furthermore, the support plates 8 have axial holes 14 for letting through the refrigerant. In the embodiment depicted in FIG. 9, the axial holes 14 are formed between the through holes 12 into which the heat-transfer tubes 4 are inserted.

In the above embodiment, the refrigerant can move freely in the longitudinal direction of the vessel 2 through the axial holes 14. Thus, if different amounts of gas-phase refrigerant are generated between adjacent sections P1 and P2, or P2 and P3, or the like in FIG. 2, for instance, to cause variation in the hydraulic head pressure, the liquid-phase refrigerant can transfer through the axial holes 14 in accordance with the variation, which makes it possible to improve the heat-exchange efficiency of the evaporator 1.

In some embodiments, the axial holes 14 may be holes in which the heat-transfer tubes 4 are inserted and which have a diameter larger than the outer diameter of the heat-transfer tubes 4. In this case, since the heat-transfer tubes 4 are inserted through the axial holes 14, clearance is formed between the outer peripheries of the heat-transfer tubes 4 and the edges of the axial holes 14. The refrigerant inside the vessel 2 can move freely through the clearance.

In this case, the axial holes 14 also serve as the through holes 12 for supporting the heat-transfer tubes 4.

However, in this case, the heat-transfer tubes 4 are inserted through the axial holes 14 having a diameter larger than the outer diameter of the heat-transfer tubes 4, which may cause the support plates 8 to fail to support the heat-transfer tubes 4 sufficiently. Thus, on the edge portions of the axial holes 14 of the support plates 8, projections protruding inward in the radial direction may be provided as support portions for supporting the heat-transfer tubes 4 to support the heat-transfer tubes 4 via the projections.

In some embodiments, the refrigerant to be supplied to the evaporator 1 has a saturated pressure of 0.2 MPa (G) at a temperature of 38° C.

When liquid refrigerants having the same mass and different saturated vapor pressures are evaporated, the refrigerant having a lower saturated vapor pressure turns into steam of a larger volume than the refrigerant having a higher saturated vapor pressure. Accordingly, if a refrigerant having a relatively low saturated vapor pressure is evaporated by the evaporator 1, a larger amount of gas-phase refrigerant is produced to exist in a liquid-phase refrigerant, which increases the risk of dry out around the heat-transfer tubes 4 and carry over of the refrigerant. Thus, if a refrigerant having a relatively low saturated vapor pressure is used, it is especially important to suppress dry out and carry over.

In some embodiments, as the refrigerant, used is a hydrofluorocarbon (HFC) based refrigerant, a hydrochlorofluorocarbon (HCFC) based refrigerant, or a hydrofluoroolefin (HFO) based refrigerant. In some embodiments, a hydrofluoroolefin (HFO) based refrigerant is used.

Figure 13:
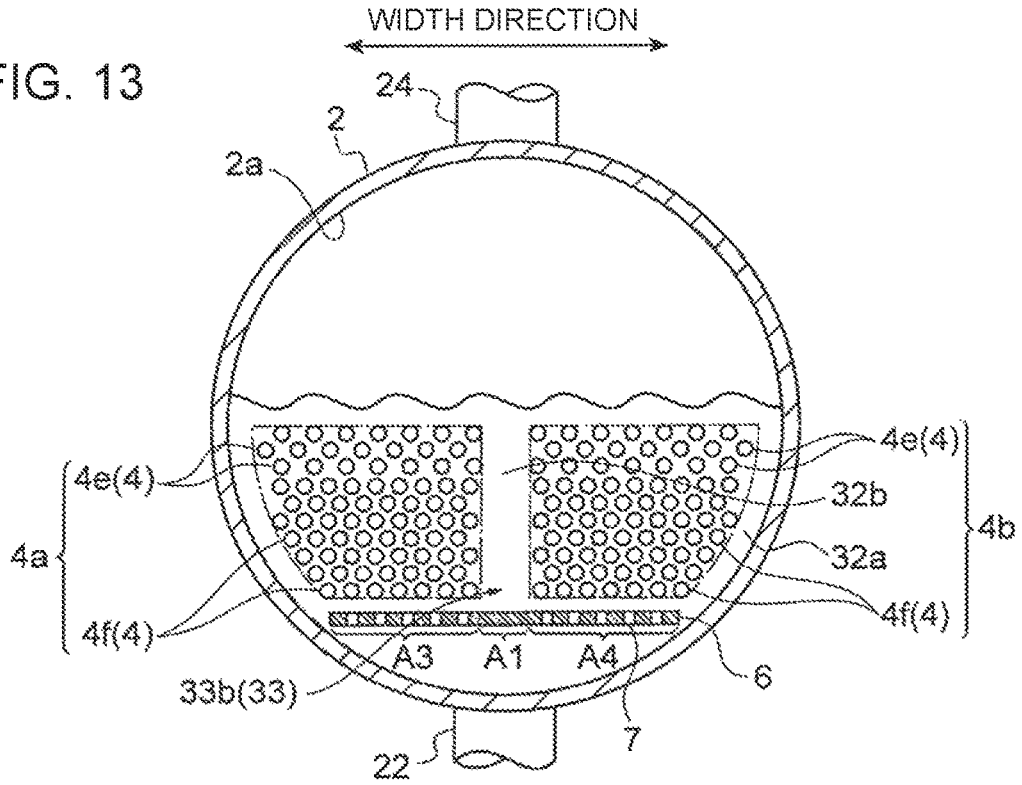
FIG. 13 is a schematic transverse cross-sectional view of an evaporator according to an embodiment.
Figure 14:
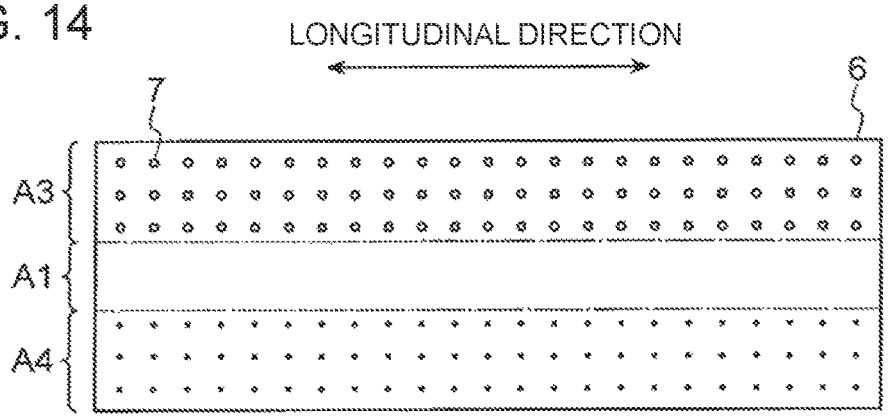
FIG. 14 is a schematic planar view of a partition plate according to an embodiment.
Figure 15:
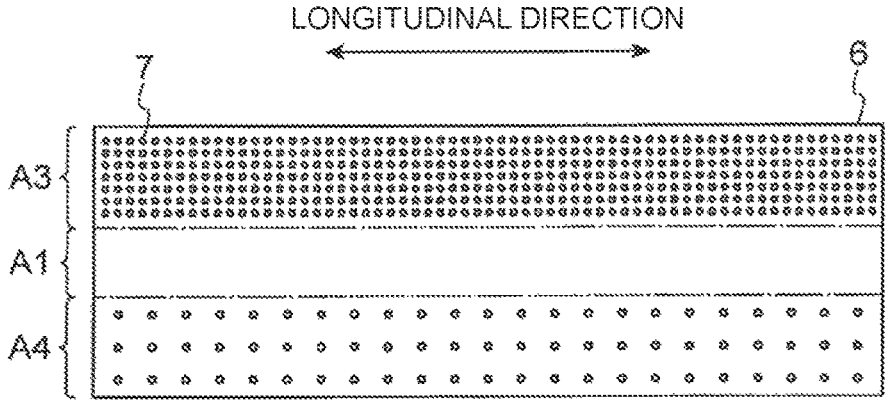
FIG. 15 is a schematic planar view of a partition plate according to an embodiment.

Here, FIG. 13 is a schematic transverse cross-sectional view of an evaporator according to an embodiment, and FIGS. 14 and 15 are each a schematic planar view of a partition plate according to an embodiment depicted in FIG. 13.

While the header section 3A is divided inside into an upper section and a lower section by the division wall 5 in some embodiments described above, the header section 3A may be divided into a right section and a left section. In this case, one of the right and left sections divided by the division wall 5 is the inlet-side space, and the other one is the outlet-side space. Furthermore, the heat-transfer tubes (inlet-side heat-transfer tubes) 4*a* connected to the inlet-side space and the heat-transfer tubes (outlet-side heat-transfer tubes) 4*b* connected to the outlet-side space are disposed to be separated on the right and left sides, in other words, separated on opposite sides in the width direction, at the intermediate section of the vessel 2, as depicted in FIG. 13 for instance.

In the case of such a right-and-left arrangement, the flow-path area defined by the through holes 7 formed in region A3 of the partition plate 6 facing the heat-transfer tubes 4*a* may be larger than the flow-path area defined by the through holes 7 formed in region A4 of the partition plate 6 facing the heat-transfer tubes 4*b*.

Accordingly, the flow-path area defined by the through holes 7 in region A3 is relatively greater than the flow-path area defined by the through holes 7 in region A4, and thereby it is possible to supply a greater amount of the refrigerant to the heat-transfer tubes 4*a* carrying a fluid having a relatively higher temperature than the outlet-side heat-transfer tubes 4*b*. Thus, it is possible to improve the heat-exchange efficiency of the evaporator 1.

For instance, in the case of the right-and-left arrangement, as depicted in FIG. 13, the diameter of the through holes 7 formed in region A3 of the partition plate 6 facing the heat-transfer tubes 4*a* may be smaller than the diameter of the through holes 7 formed in region A4 of the partition plate 6 facing the heat-transfer tubes 4*b*.

With the above configuration, if the refrigerant supplied to the refrigerant inlet 22 is in a gas-liquid mixed state, it is possible to supply a relatively larger amount of the liquid-phase refrigerant, which has a relatively high heat-transfer efficiency, to the inlet-side heat-transfer tubes 4*a* carrying a fluid having a higher temperature than the outlet-side heat-transfer tubes 4*b*. Thus, it is possible to improve the heat-exchange efficiency of the evaporator 1.

Furthermore, in the case of the right-and-left arrangement, as depicted in FIG. 14, the number per unit volume (number density) of the through holes 7 formed in region A3 of the partition plate 6 facing the heat-transfer tubes 4*a* may be greater than the number density of the through holes 7 formed in region A4 of the partition plate 6 facing the heat-transfer tubes 4*b*.

With the above configuration, it is possible to supply a relatively larger amount of refrigerant to the inlet-side heat-transfer tubes 4*a* carrying a fluid having a higher temperature than the outlet-side heat-transfer tubes 4*b*. Accordingly, it is possible to improve the heat-exchange performance of the evaporator 1.

Embodiments of the present invention were described in detail above, but the present invention is not limited thereto, and various amendments and modifications may be implemented within a scope that does not depart from the present invention. For instance, some of the above described embodiments may be combined upon implementation.

DESCRIPTION OF REFERENCE NUMERALS

1 Evaporator
2 Vessel
2*a* Inner wall surface
3A, 3B Header section
4 Heat-transfer tube
4*a*, 4*b* Heat-transfer tube
4*e* Upper heat-transfer tube
4*f* Lower heat-transfer tube
5 Division wall
6 Partition plate
7 Through hole
8 Support plate
12 Through hole
14 Axial hole
22 Refrigerant inlet
24 Refrigerant outlet
26 Fluid inlet
28 Fluid outlet
32 Downward flow passage
32*a* Peripheral downward flow passage
32*b* Intermediate downward flow passage
33 Lower opening
34 Upward flow passage
100 Refrigerator
102 Refrigerant line
104 Compressor
106 Condenser
108 Expander
110 Cold load
112 Fluid line
114 Pump
R1 Inlet vicinity region
R2 Inlet remote region

The invention claimed is:

1. An evaporator, comprising:

a vessel having a refrigerant inlet for receiving a refrigerant at a lower part of the vessel, and a refrigerant outlet for discharging the refrigerant in an evaporated state at an upper part of the vessel; and a plurality of heat-transfer tubes disposed so as to extend inside the vessel along a longitudinal direction of the vessel, and configured to transfer heat received from a fluid flowing inside the heat-transfer tubes to the refrigerant flowing outside the heat-transfer tubes, wherein the plurality of heat-transfer tubes are disposed so that at least one downward flow passage is defined through the plurality of heat-transfer tubes or around the plurality of heat-transfer tubes, the at least one downward flow passage having a width larger than a representative interval between the plurality of heat-transfer tubes, and wherein the plurality of heat-transfer tubes includes:

a plurality of upper heat-transfer tubes having a first representative interval between the plurality of upper heat-transfer tubes; and a plurality of lower heat-transfer tubes disposed below the plurality of upper heat-transfer tubes and having a second representative interval between the plurality of lower heat-transfer tubes, the second representative interval being smaller than the first representative interval, wherein the evaporator further comprises a partition plate disposed between the refrigerant inlet and a lower opening of the at least one downward flow passage, wherein the partition plate extends along the longitudinal direction of the vessel and between the refrigerant inlet and the plurality of heat-transfer tubes, and has a plurality of through holes at least in a region facing the plurality of heat-transfer tubes, wherein the vessel has an inlet of the fluid on one end side in the longitudinal direction of the vessel, wherein the partition plate has:

a first half portion disposed in an inlet vicinity region disposed on a side of the inlet of the fluid; and a second half portion disposed opposite to the first half portion across a midpoint of the partition plate in the longitudinal direction, the second half portion being disposed in an inlet remote region disposed remote from the inlet of the fluid in the longitudinal direction of the vessel, and wherein a flow-path area defined by the plurality of through holes formed at the first half portion in the inlet vicinity region of the partition plate is greater than a flow-path area defined by the plurality of through holes formed at the second half portion in the inlet remote region of the partition plate.

2. The evaporator according to claim 1, wherein a diameter of the through holes is smaller in the inlet vicinity region of the partition plate than in the inlet remote region of the partition plate.

3. The evaporator according to claim 1, wherein a number per unit area of the plurality of through holes is greater in the inlet vicinity region of the partition plate than in the inlet remote region.

4. The evaporator according to claim 1, wherein the at least one downward flow passage comprises a peripheral downward flow passage extending between an inner wall surface of the vessel and the plurality of heat-transfer tubes.

5. The evaporator according to claim 1, wherein the at least one downward flow passage comprises an intermediate downward flow passage extending in an upward-and-downward direction through the plurality of heat-transfer tubes.

6. An evaporator according to claim 1, wherein the at least one downward flow passage has a width which reaches its maximum in an upper most part of the at least one downward flow passage, in a transverse cross section taken orthogonal to the longitudinal direction of the vessel.

7. An evaporator according to claim 1, wherein the at least one downward flow passage has a width which increases gradually downward, in a transverse cross section taken orthogonal to the longitudinal direction of the vessel.

8. The evaporator according to claim 1, wherein the plurality of upper heat-transfer tubes are disposed so that at least one upward flow passage is defined through the plurality of upper heat-transfer tubes, the at least one upward flow passage having a width larger than the first representative interval between the plurality of upper heat-transfer tubes.

9. The evaporator according to claim 1, further comprising a support plate which has a plurality of through holes into which the plurality of heat-transfer tubes are inserted, and which is disposed so as to divide an inside of the vessel into a plurality of sections in the longitudinal direction of the vessel, while supporting the plurality of heat-transfer tubes, wherein the support plate further includes an axial hole for letting through the refrigerant.

10. The evaporator according to claim 1, wherein the refrigerant has a saturated pressure of not more than 0.2 MPa (G) at a temperature of 38° C.

11. The evaporator according to claim 1, wherein the vessel has a header section on at least one end side in the longitudinal direction of the vessel, the header section having an inlet-side space communicating with an inlet of the fluid and an outlet-side space communicating with an outlet of the fluid, wherein the heat-transfer tubes include:

an inlet-side heat-transfer tube connected to the inlet-side space; and an outlet-side heat-transfer tube connected to the outlet-side space, and wherein the inlet-side heat-transfer tube and the outlet-side heat-transfer tube are disposed so as to be separated on opposite sides in a width direction of the vessel.

12. A refrigerator, comprising:

a compressor for compressing a refrigerant;

a condenser for condensing the refrigerant compressed by the compressor;

an expander for expanding the refrigerant condensed by the condenser; and an evaporator for evaporating the refrigerant expanded by the expander, wherein the evaporator is the evaporator according to claim 1.

13. The evaporator according to claim 1, wherein the partition plate has the plurality of through holes in a region which overlaps with the plurality of heat-transfer tubes in a plan view.

* * * * *